US007008051B2

(12) United States Patent
Akermalm

(10) Patent No.: US 7,008,051 B2
(45) Date of Patent: Mar. 7, 2006

(54) EXPANDED INK SUPPLY SYSTEM FOR INK JET PRINTERS

(76) Inventor: Per G. Akermalm, 111 Decou Road, Simcoe, Ontario (CA) N3Y 4K2

( * ) Notice: Subject to any disclaimer, the term of this patent is extended or adjusted under 35 U.S.C. 154(b) by 174 days.

(21) Appl. No.: 10/680,149

(22) Filed: Oct. 8, 2003

(65) Prior Publication Data

US 2004/0125182 A1 Jul. 1, 2004

Related U.S. Application Data

(60) Provisional application No. 60/417,130, filed on Oct. 10, 2002.

(51) Int. Cl.
*B41J 2/175* (2006.01)

(52) U.S. Cl. ..... 347/85

(58) Field of Classification Search ..... 347/67, 347/84, 85, 86, 87; 141/2, 10, 18, 326; 222/206, 222/213, 215

See application file for complete search history.

(56) References Cited

U.S. PATENT DOCUMENTS 4,429,320 A * 1/1984 Hattori et al. ..... 347/86
4,475,116 A * 10/1984 Sicking et al. ..... 347/86
4,558,326 A * 12/1985 Kimura et al. ..... 347/30
4,628,332 A * 12/1986 Matsumoto ..... 347/49
4,636,814 A * 1/1987 Terasawa ..... 347/86
4,719,472 A * 1/1988 Arakawa ..... 347/67
5,369,429 A * 11/1994 Erickson ..... 347/7
5,650,811 A * 7/1997 Seccombe et al. ..... 347/85
5,721,576 A * 2/1998 Barinaga ..... 347/85
6,030,074 A 2/2000 Barinaga
6,109,740 A 8/2000 Namekawa et al.
6,183,073 B1 2/2001 Rottman et al.
6,264,318 B1 * 7/2001 Oda et al. ..... 347/86
6,283,586 B1 * 9/2001 Childers ..... 347/85
6,805,437 B1 * 10/2004 Yamanaka et al. ..... 347/92

FOREIGN PATENT DOCUMENTS

JP 61206660 A * 9/1986

* cited by examiner

*Primary Examiner*—Anh T. N. Vo
(74) *Attorney, Agent, or Firm*—George A. Rolston

(57) ABSTRACT

The invention provides an expanded ink supply system for inkjet printers. The expanded ink supply system fluidically supplies an ink cartridge, which is intermittently fluidically connected to an array of movable printheads. Described are various means for creating the necessary pressure to force the ink from the expanded supply to a print cartridge. In one described embodiment, the ink supply is in the form of a bag, placed at a level higher than the ink cartridge, thereby utilizing gravity to force the liquid ink via tubing into the ink cartridge's inner part fill port or alternatively, the cartridge's pump channel. Also described are steps to attach a fitting in the cartridge's inner part fill port or pump channel and steps for releasing trapped air from the ink supply system.

18 Claims, 8 Drawing Sheets

EXPANDED INK SUPPLY SYSTEM FOR INK JET PRINTERS

This application claims benefit of U.S. Provisional Application No. 60/417,130, filed Oct. 10, 2002.

FIELD OF THE INVENTION

The invention relates to an expanded ink supply for ink jet printers.

BACKGROUND OF THE INVENTION

This invention relates to replaceable ink supply systems. More specifically, the present invention relates to expanded ink supply systems for inkjet printers generally comprising an array of detachably mounted print cartridges containing a limited amount of ink and an array of separate print heads mounted on a carriage that reciprocates across a print medium such as paper in an inkjet printer. For the purposes of this invention it is necessary to distinguish between cartridges with printheads that are affixed to a cartridge and cartridges with separate printheads.

The expanded ink supply system according to the present invention comprises a used or new cartridge for the type of printers that are equipped with separate printheads, an expanded ink supply consisting of a bag containing ink and tubing that fluidically connects the bag to said ink cartridge. The bag is advantageously, but not necessarily, equipped with two ports for the ink of which one is used for filling and the other one for supplying the cartridge.

Ink supplies for inkjet printers with separate printheads generally consist of a cartridge equipped with a pump and a septum to intermittently supply a separate printhead via fluid conduit to a printhead filling station typically located at one end of the printer carriage's maximum stroke. Separate printheads must be protected against damage by a continuous supply of ink and therefore, ink cartridges in printers of said kind are equipped with electronic means to estimate the ink consumption and to stop a printer from working when the quantity of ink in a cartridge is estimated to be depleted or close to being depleted. A depleted cartridge is still fully functional and such cartridges are often manually refilled for continued use. The refilling procedure is time consuming and also creates objectionable stains on persons and materials. The present invention makes refilling unnecessary insomuch that the quantity of ink in the expanded ink supply system is several times the quantity in the original cartridges.

It is commonly held by persons skilled in the art that printheads should operate under negative pressure as described in U.S. Pat. No. 6,283,586. Positive printhead pressure may cause the printhead to drool. This is only of particular concern for printheads that are affixed to a cartridge, but not to printers equipped with separate printheads of the kind here described. In printers with separate printheads, overpressure conditions in the ink emanating from an external ink supply will be diminished or stopped by the cartridge's internal valve and a septum in the printhead fill station. Thus, the pressure to the printhead is unchanged and will still be regulated by the printhead pressurization mechanism.

The present invention employs continuous overpressure to prevent air ingestion into the cartridge and the fluid connections, which is beneficial to prevent air ingestion. Air that reaches the printheads may damage them severely. A liquid such as an ink solution will be more disposed to dissolve air when the solution is under negative pressure. Thus, printing systems relying on capillary action and accompanying negative pressure will be more prone to air ingestion and the printheads in such systems will deteriorate more rapidly. Another reason, according to U.S. Pat. No. 6,283,586, is that each original cartridge contains a certain amount of air and frequent cartridge replacements due to the small ink capacity of the original cartridges, the printhead air budget limit will thus be exceeded in a shorter time span than when, advantageously, expanded ink supplies of the kind described in the present invention are used. Due to prevention of air ingestion in the fluid train from the expanded ink supply up to and including the cartridge's septum and the diminished amount of air that thus may reach the printheads, according to this invention, overpressure conditions corresponding to between 50 and 200 millimeters prolong the life of printheads.

Positive pressure conditions according to the present invention are accomplished by several means. The preferred embodiment of the invention uses the force of gravity to directly feed ink from an inkbag at a higher level than the ink cartridge inside the printer. Indirect use of gravity or the use of a bag to feed a cartridge is recited in U.S. Pat. No. 5,751,319 describing an arrangement in which the cartridge is fed at a pressure substantially close to zero by employing a float valve to regulate the flow to the cartridge, while U.S. Pat. No. 5,369,429 describes a system with an ink bag where the ink cartridge is kept at sub-atmospheric pressure and the printhead and cartridge are one unit. Several inventors (U.S. Pat. No. 6,030,074 to Barinaga, U.S. Pat. No. 6,183,073 to Rottman et al. and U.S. Pat. No. 6,109,740 to Namekawa et al.) describe mechanical or fluidic pressurizing systems for a printer using a rigid container around an inner deformable bag to feed a cartridge and where the printhead and cartridge also are one unit which thus—unlike the present invention—directly pressurizes the printhead.

In an alternative embodiment of the present invention, the inkbag is pressurized by placing the printer itself over the inkbag. Typically, a printer relies on three ink colours (cyan, yellow and magenta) in addition to black ink and these inks are then stored in four separate bags. When the ink bags are pressurized by the mass of the printer itself, the inkbags according to the present invention are horizontally disposed between two surfaces of which at least one is compressible to equalize the variances in pressure in the inkbags. Using commercially available foam with a thickness of ¾" to 1½" as a compressible plate, a printer weighing 15–20 lbs typically forces the ink to a height 12 –18 inches above the level of the foam plate.

Pressurizing the system using gravity once the system is assembled is important. Equally important are methods described in the present invention to remove air from the expanded ink supply system during assembly. One such mechanical method according to the invention employs the forced movement of the ink through the fluid conduit to force any air to locations in the system where the air can be removed, which is described below.

The major quantity of air present in the expanded system after filling with ink is collected by allowing the ink to flow between the cartridge and the expanded ink bag in such a way that any air bubbles in the system are collected in the expanded ink bag. Most advantageously, but not necessarily, the ink bag is equipped with two openings of which one is in fluid connection with the cartridge and the other one is used for filling and also expelling visible air bubbles.

An alternative method to remove air from the system makes use of the cartridge pump and septum. By first forcing any air bubbles present in any part of the expanded ink supply system to the cartridge and then orienting the cartridge so the air is collected in close proximity to the pump channel, air can be admitted to the pump chamber by operating the diaphragm of the pump mechanism. A hollow needle is forced into the cartridge septum to allow air or air and ink mixed together to be expelled from the pump chamber when the pump's flexible diaphragm is pressed. Preferably, the hollow needle is attached to tubing and a container to collect the air/ink effluent mixture.

A method to permanently seal said fill port of the ink bag after air has been released and only ink is present in said fill port is also included in the present invention. This is accomplished by inserting suitable fittings into the ports of the bag. One of said fittings is used in the bag's fill port and is also connected to a main ink fill supply via tubing. The fittings are thermoplastically deformable so that a suitable hot tool can melt and fuse the fitting end connected to the main ink fill supply making it possible to seal the bag after air has been expelled through the fitting to the main ink fill supply and only ink is present in the fitting.

Although cartridges of the type here described have electronic means to estimate the quantity of ink remaining in a cartridge in an inkjet printer and such means are helpful when a cartridge is new, such means are of no use when used cartridges are continuously supplied from an expanded ink supply according to the present invention. Typically, a new cartridge will report that the ink level is low or the cartridge is empty when it is removed after first use from the printer as is explained in U.S. Pat. No. 6,170,937. After refilling with new ink, the cartridge's integral memory chip will still report that the ink level is the same as it was when the cartridge was removed. An empty condition will however revert to being reported as low ink condition when used for the purposes of this invention. The present invention does not rely on electronic reporting of the ink condition. Instead, simple and dependable visual means are employed. Thus, a prominent and important feature of the invention is the transparent conduit used and, optionally, the transparent casing for the original ink cartridge that both are helpful for estimating how much ink is left in the system. Also, the inkbags are advantageously, but not necessarily, transparent.

We now turn to the specific methods for gaining access to the first quantity of ink contained in the inner part of a used or new cartridge. Ink cartridges for use together with separate printheads typically have three main parts comprising firstly the inner part with the first quantity of ink in a container and pump mechanism, secondly the end cap containing the microchip for reporting the ink condition and thirdly the casing. The inner part is enclosed in the casing and the end cap. The casing and said end cap are joined together by common mechanical means and a label tape. Severing of the casing and the end cap is commonly done by removing said tape or cutting through it with a knife, both methods long known and described in early now expired patents. Therefore, such rudimentary methods to gain access to the inner part are not further described for the purposes of this invention. In a new cartridge, the cartridge's inner part fill port is in the shape of a tube blocked by an elastic body fitting the inside of the tube. Although basic and common tools are employed, such as using a threading tap or a pointed tool, methods to remove the elastic body, most often in the form of a ball, are described more recently in U.S. Pat. Nos. 6,170,937 and 6,283,586. The present invention includes a novel method to remove the elastic body from said tube by inserting a tool shaped like a fishhook's barbed end into the elastic body and then pulling it out making the cartridge inner part fill port open for insertion of a fitting.

The elbow fitting to be inserted into the cartridge's inner part fill port is most advantageously equipped with barbs for attaching tubing at one end while the fitting is threaded at the end to be screwed into the cartridge's inner part fill port. Therefore the inside of the inner part fill port must first be threaded by use of a common tap with the same thread as that of the fitting. A common sealing compound may be applied to the fitting before it is screwed into the cartridge's inner part fill port. Alternatively, an angled fitting with barbs at both ends to which optionally a common sealing compound has been applied, can be pushed into the inner part fill port. During assembly of the expanded ink supply system, for both types of fittings, flexible tubing is forced over the barbed end, pushed through an opening in the cartridge casing and then connected to the barbed end of a fitting inserted into the ink bag outlet port. The cartridge, the ink bag and the tubing now comprise the expanded ink system and is ready for filling. In a third alternative, a U-shaped fitting with barbed ends is used. One of the legs of the U is pushed into the cartridge's inner part fill port while the other leg is attached to tubing leading out of the cartridge through a hole and then connected to said ink bag.

SUMMARY OF THE INVENTION

The invention applies to an expanded ink supply for inkjet printers that have detachably removable cartridges and printheads separately mounted in a carriage transversing a medium such as paper. An expanded ink supply of the type here described comprises a collapsible bag containing ink, fluid conduit to continuously transfer the ink to an existing ink cartridge and means to attach said fluid conduit to an existing ink cartridge. In a first preferred embodiment, positive pressure is created by placing the bag at a higher level than the cartridge by suspending the bag from a stand. In a second alternative, positive pressure can be created by placing the printer over the cartridge. The coupling of the conduit to the cartridge is done by removing an elastic body inserted into the cartridge's inner part fill port by using a hook and then threading the inner part fill port with a tap. The fitting for the fluid conduit is then screwed into the threaded inner part fill port. Alternatively, the elastic body is removed with the hook and a barbed elbow or U-shaped fitting is then pushed into the inner part fill port.

The invention includes several modifications to a cartridge such as severing and permanently removing the part of the cartridge's ink container that contains the first quantity of ink to reveal the pump channel into which a barbed or threaded fitting is inserted and coupled to an inkbag via fluid conduit.

Also included in the invention are steps to remove air from the system by pumping using said cartridge's flexible diaphragm and by closing an ink bag after filling with ink using a heat sealing method to prevent air from re-entering through the bag fill port.

The stand for suspension of ink bags according to the invention advantageously consists of an upright such as a rod or tube of metal or polymeric material, a cap to top off the upright and a base plate of such a shape that part of the stand's base can be inserted underneath an inkjet printer to stabilize the stand with the suspended ink bags.

In the drawings, which form part of this specification:

FIG. 3 is a perspective view showing the stand illustrating a base plate, an upright, a cap, inkbags and a cross arm to suspend said ink bags from;

DETAILED DESCRIPTION OF THE INVENTION

Figure 1:
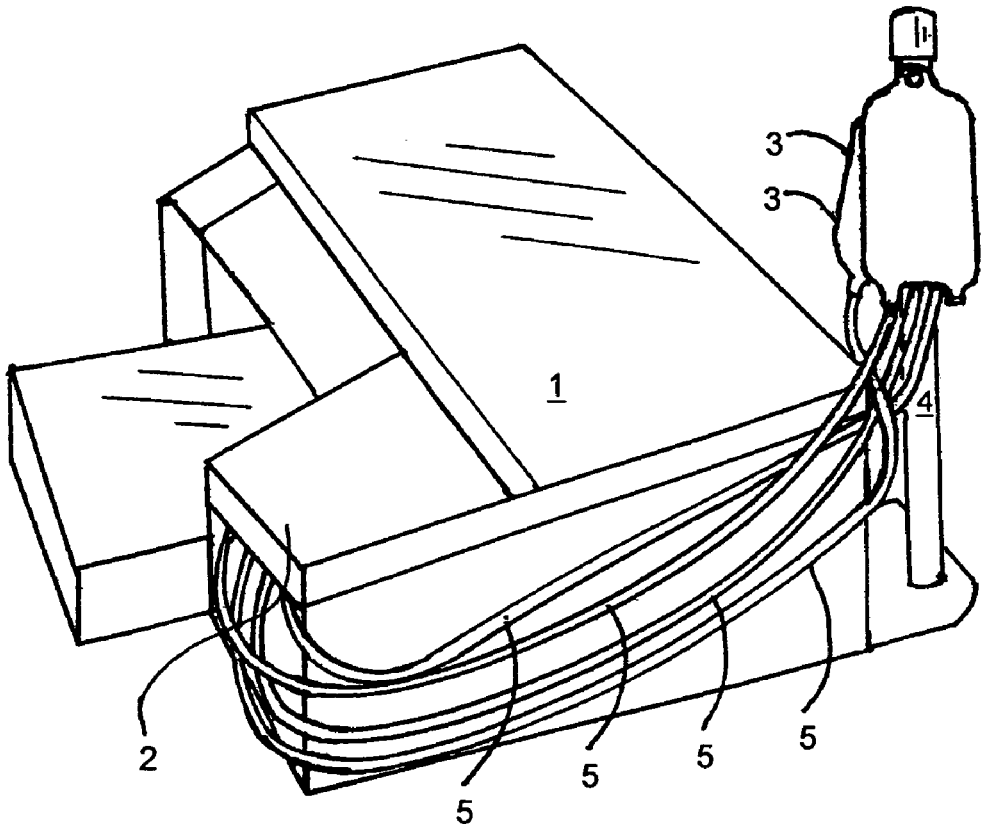
FIG. 1 depicts a printer with an expanded ink supply system attached to it.
Figure 2:
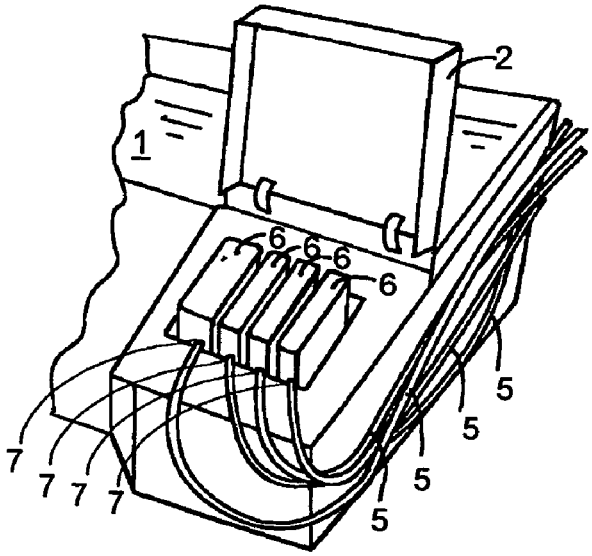
FIG. 2 is a partial view of a printer with the lid over the cartridges in the open state.

In the preferred embodiment of the invention illustrated in FIG. 1, the expanded ink supply system comprises inkbags 3 suspended from stand 4, fluidically connected with tubing 5 to printer 1. Tubing 5 enters printer 1 under the partially open lid 2*b*, which covers print cartridge compartment 2. As seen in FIG. 2, tubing 5 enters cartridges 6 through holes 7.

Figure 3:
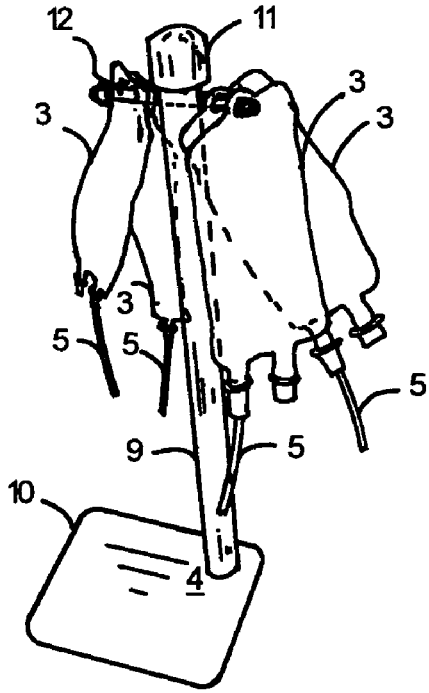
Figure 4:
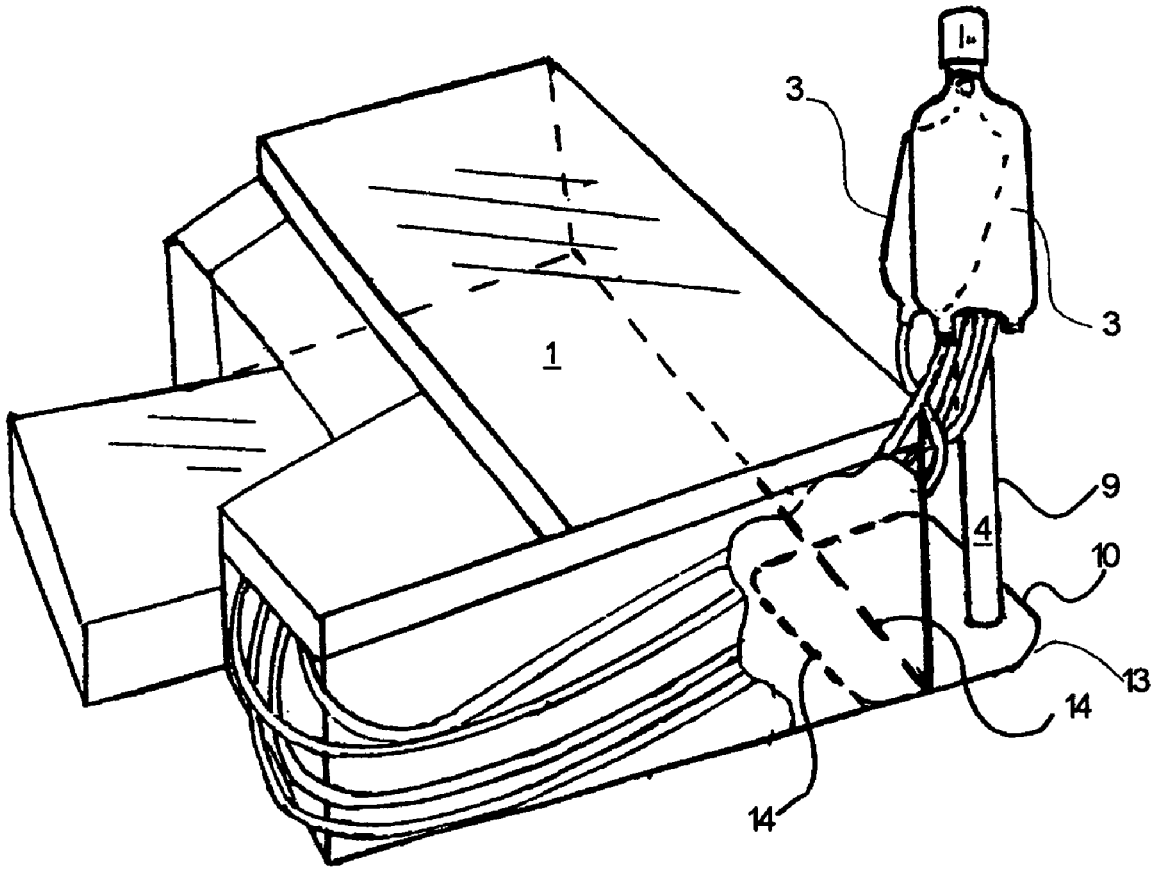
FIG. 4 is a perspective view with a cutout showing the base plate of said stand inserted under the bottom of a printer.

Stand 4 comprises as seen in FIG. 3 base plate 10, upright 9 and cap 11, all made of metal or polymeric material. Bags 3 are suspended from cross arm 12. Base plate 10 is advantageously, but not necessarily, square and of adequate thickness to provide stable support for upright 9 and bags 3. As seen in FIG. 4, also advantageously, but not necessarily, the location of upright 9 on base plate 10 is offset toward corner 13 allowing side 14 to be inserted under an edge 15 of printer 1 to gain additional support for upright 9 and bags 3. Upright 9 is attached to base plate 10 by common means such as welding or screwing.

Figure 5:
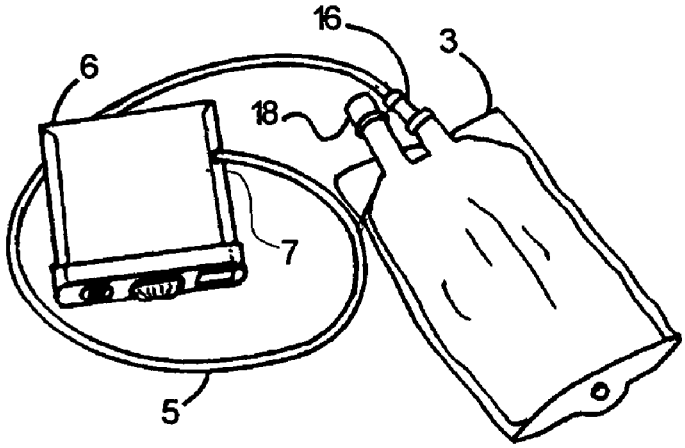
FIG. 5 depicts an expanded ink supply's fluidically coupled components in the assembled state.

As illustrated in FIG. 5 a unitary inkbag assembly comprises inkbag 3, tubing 5 and cartridge 6. Inkbag 3 is coupled to tubing 5 via bag outlet port 16. Bag fill port 18 is sealed and further described in FIG. 6. Tubing 5 enters casing 22 of cartridge 6 via casing opening 7.

Figure 6:
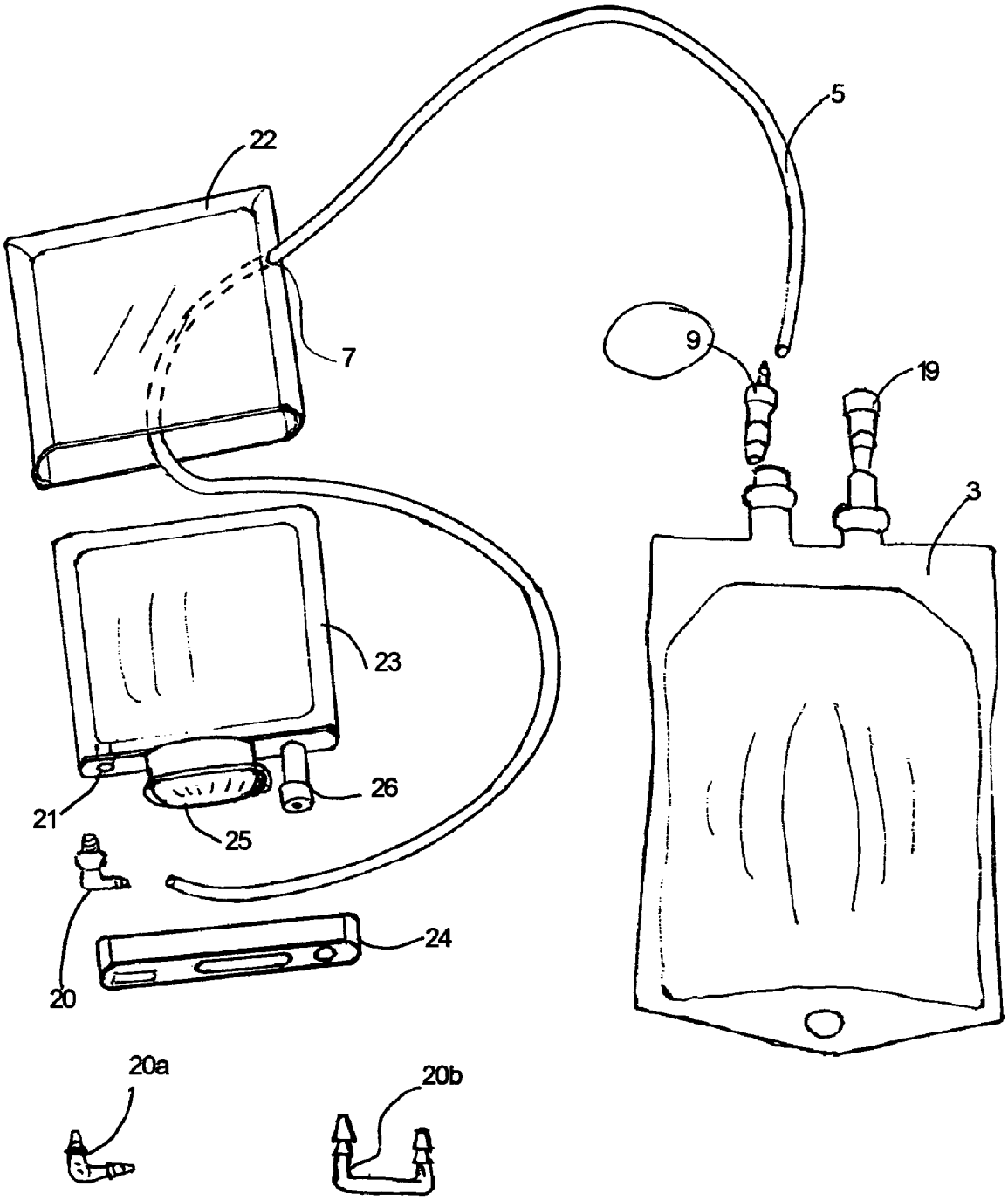
FIG. 6 is an exploded view depicting said expanded ink supply's fluidically coupled components in the dis-assembled state.
Figure 10:
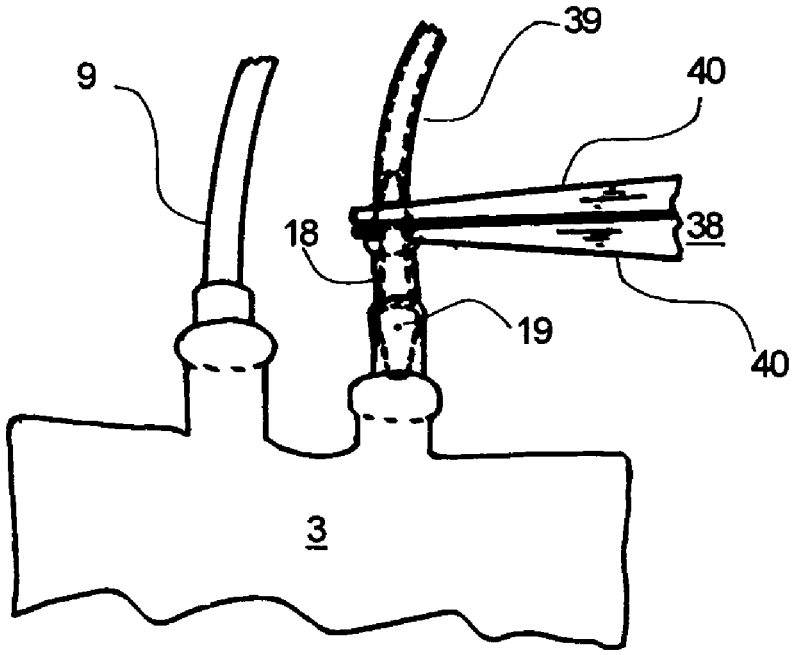
FIG. 10 is a perspective view depicting the nose of a tool being used to seal a fitting of an inkbag.

As seen in the exploded view in FIG. 6, inkbag 3 is sealed at bag fill port 18 by bag fill port fitting 19 most advantageously, but not necessarily, utilizing the sealing method described herein and depicted in FIG. 10. Bag outlet port fitting 17 is inserted in bag outlet port 16. Tubing 5 is attached to bag outlet port fitting 17, inserted through casing opening 7 and continuously transfers ink via fitting 20, 20*a* or 20*b* via inner part fill port 21 to cartridge 6.

The parts of cartridge 6 are also depicted in the exploded view in FIG. 6. Casing 22, most advantageously, but not necessarily, made of transparent, polymeric material to reveal the quantity of ink left inside inner part 23, encloses inner part 23 together with end cap 24. Inner part 23 contains the first quantity of ink, while 8*b* is the inner part container cover, which is flexible and bulges when the cartridge is filled and is flat when the cartridge is about to be depleted. Inner part fill port 21 in casing inner part 23 is advantageously, but not necessarily, threaded to accommodate threaded and barbed elbow fitting 20. Alternatively, inner part fill port 21 is not threaded to accommodate barbed elbow fitting 20*a* or barbed U-shaped fitting 20*b*, both fittings barbed at both ends. Pump mechanism 25 and septum 26 are permanently affixed to inner part 23.

Figure 7:
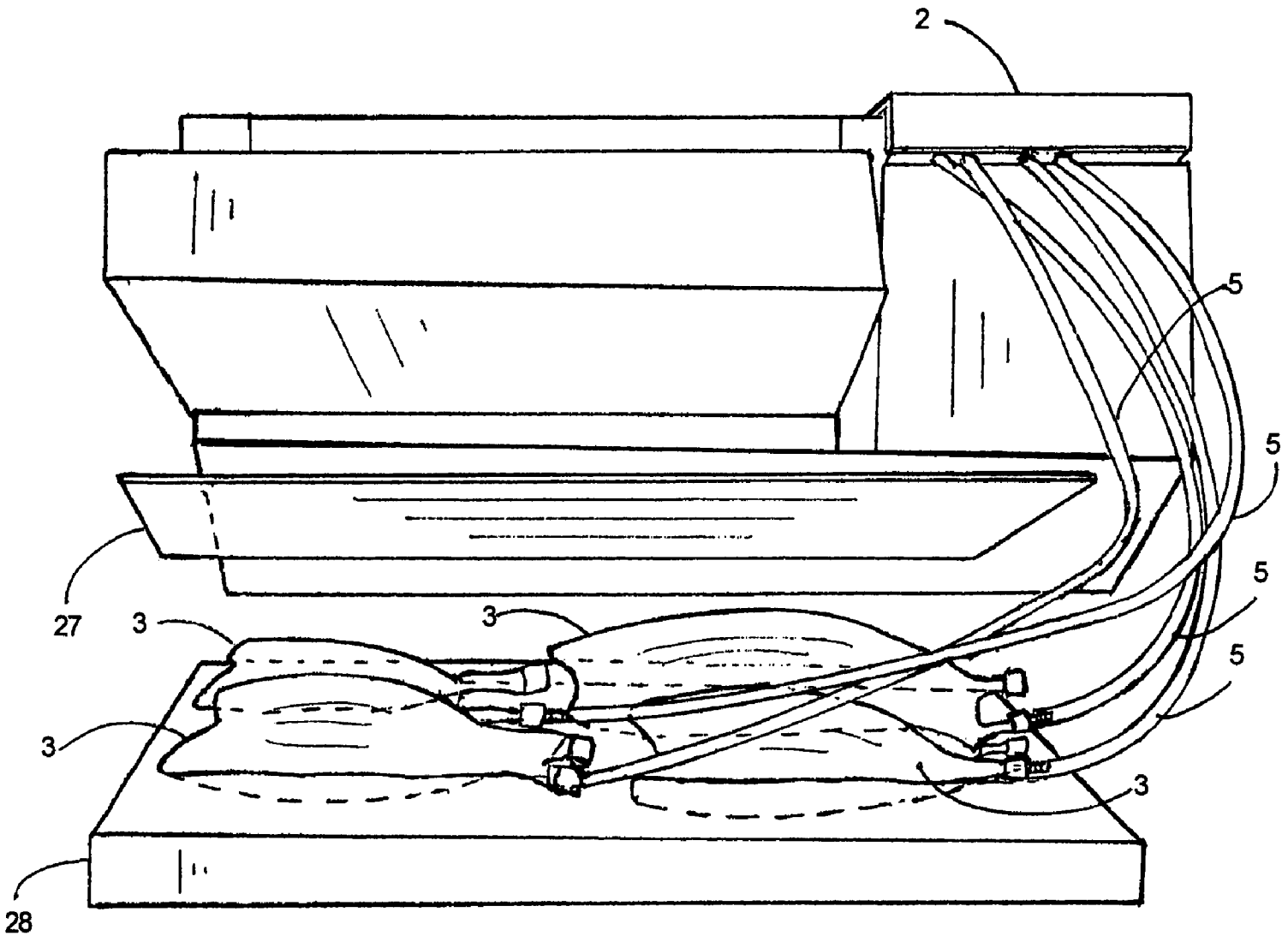
FIG. 7 is an exploded perspective view of a typical arrangement showing a printer, an intermediate pressure plate and horizontally placed inkbags placed on a compressible base plate along with fluid conduits.

As seen in FIGS. 1 and 4, bags 3 are placed at a higher level than cartridges 6 to create positive pressure. Another means to create positive pressure is seen in FIG. 7, which is an exploded view of printer 1 over pressure plate 27, which in turn is placed over ink bags 3 resting on compressible plate 28. Pressure plate 27 advantageously consists of metal or polymeric material, while compressible plate 28 consists of a compressible polymeric material such as commercially available foam sheet.

Figure 8:
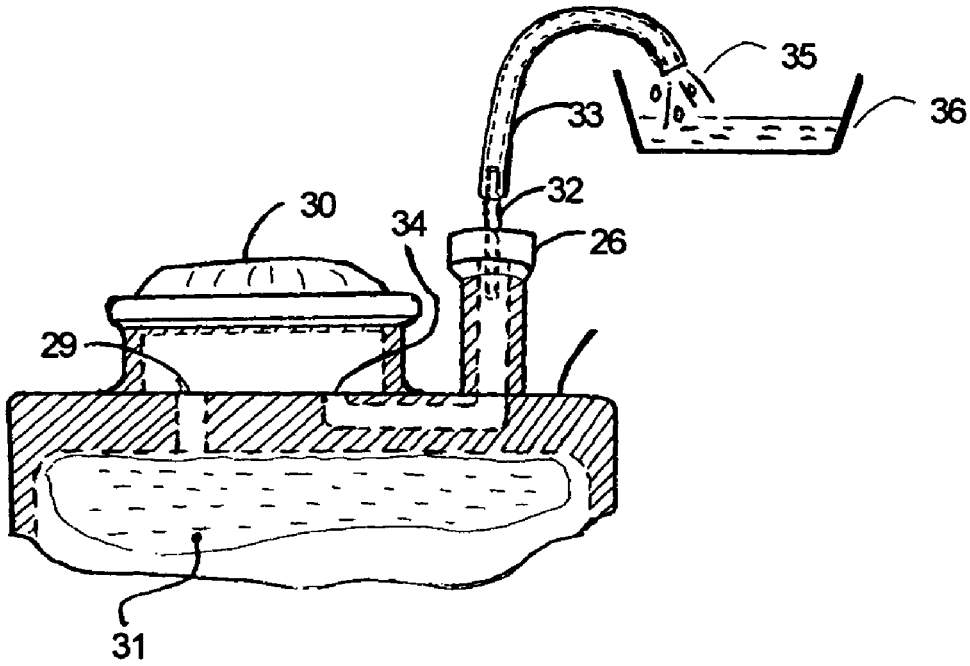
FIG. 8 is a partial sectional view of a cartridge with attached effluent tubing taken generally on a line through a cartridge's inner part.

Methods to remove air according to the invention consist of letting air escape during the fill process via bag fill port 18 in FIG. 6 or alternatively and advantageously, pump any air present in inner part 23 out via pump channel 29 and septum 26 using flexible diaphragm 30 as depicted in FIG. 8. Air 31 collects in the vicinity of pump channel 29 when the cartridge is held so flexible diaphragm 30 points upwards. A valve mechanism (not shown) inside pump channel 29 acts as a check valve and accordingly only allows liquid to flow from ink container 8 and out through septum 26. Depressing diaphragm 30 pressurizes pump chamber 34 which is in fluid connection with septum 26, hollow needle 32 and effluent tubing 33. Effluent stream 35 out of end of effluent tubing 33 typically consists of a mixture of air bubbles and ink which advantageously is collected in a container 36 for re-use in the filling process.

Figure 9:
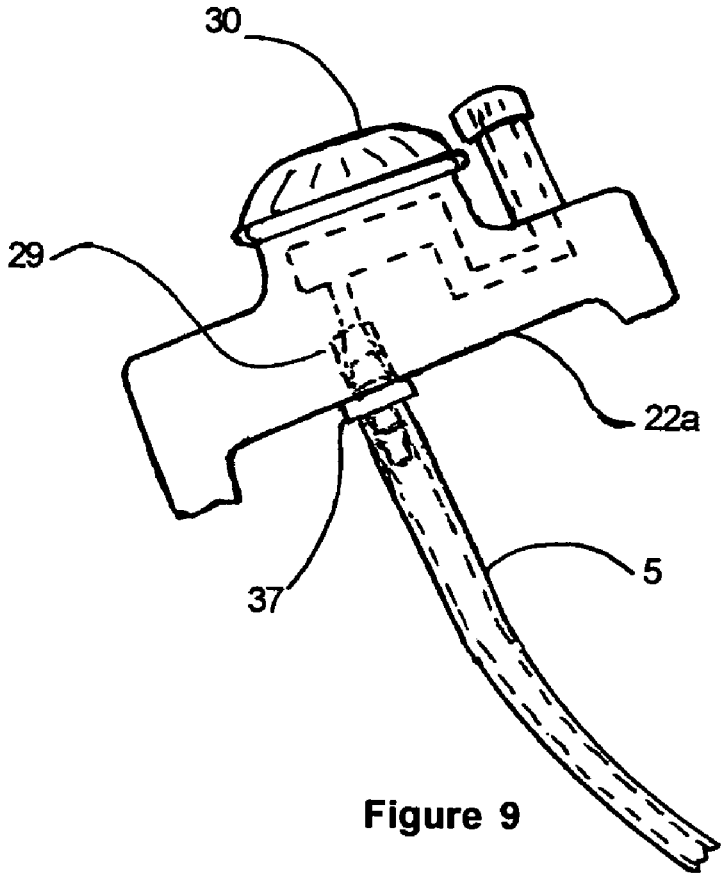
FIG. 9 is a side view of a modified cartridge with a fitting and fluid conduit inserted into a cartridge's pump channel.

Referring now to FIG. 9, another means to transfer ink to a printer 1 consists of using a part of a cartridge 6. New inner part configuration 23*a* only includes part of original inner part 23 (as seen in FIG. 6) with said pump mechanism and septum assembly remaining intact and functional allowing pump channel fitting 37 to be inserted in pump channel 29. Pump channel fitting 37 to be inserted in pump channel 29 is advantageously, but not necessarily barbed. Alternatively, pump channel 29 can be threaded to accommodate a threaded fitting.

Advantageously, but not necessarily, bags with two ports are used in the expanded ink supply system. Supply tubing 39 in FIG. 10 is in fluid connection with a main supply container (not shown here) typically containing 10 or more times ink than bag 3. After filling bag 3 to desired weight or volume, bag fill port 18 is sealed. Bag fill port 18 and bag fill port fitting 19 together with tool 38 comprise the sealing means for bag 3. During filling of bag 3, bag fill port fitting 19 and supply tubing 39 are filled with ink. Tool 38, which conveniently is equipped with two opposing and movable jaws 40, is hot and able to melt thermoplastic supply tubing 39 and thermoplastic bag fill port fitting 19 to form a durable seal when movable jaws 40 close.

Figure 11:
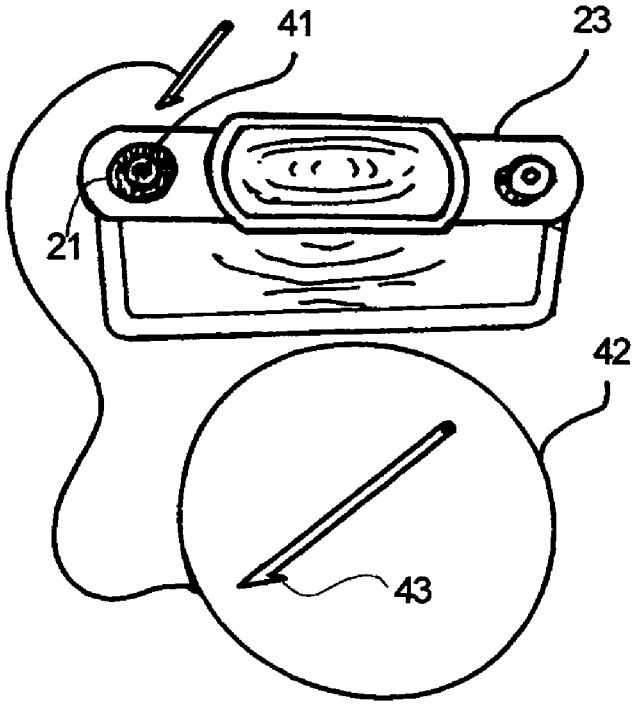
FIG. 11 is a perspective view of a hook and an elastic body in the inner part fill port of a cartridge.

Cartridge 6 inner part fill port 21 as shown in FIG. 6 is originally closed with an elastic body 41 as shown in FIG. 11. A method and a tool to remove elastic body 41 utilizes a barbed hook 42, which is pushed into body 41 preferentially at an angle to the channel formed by inner part fill port 21. When barb 43 is pushed below the surface of elastic body 41, body 41 can be pulled out.

Figure 12:
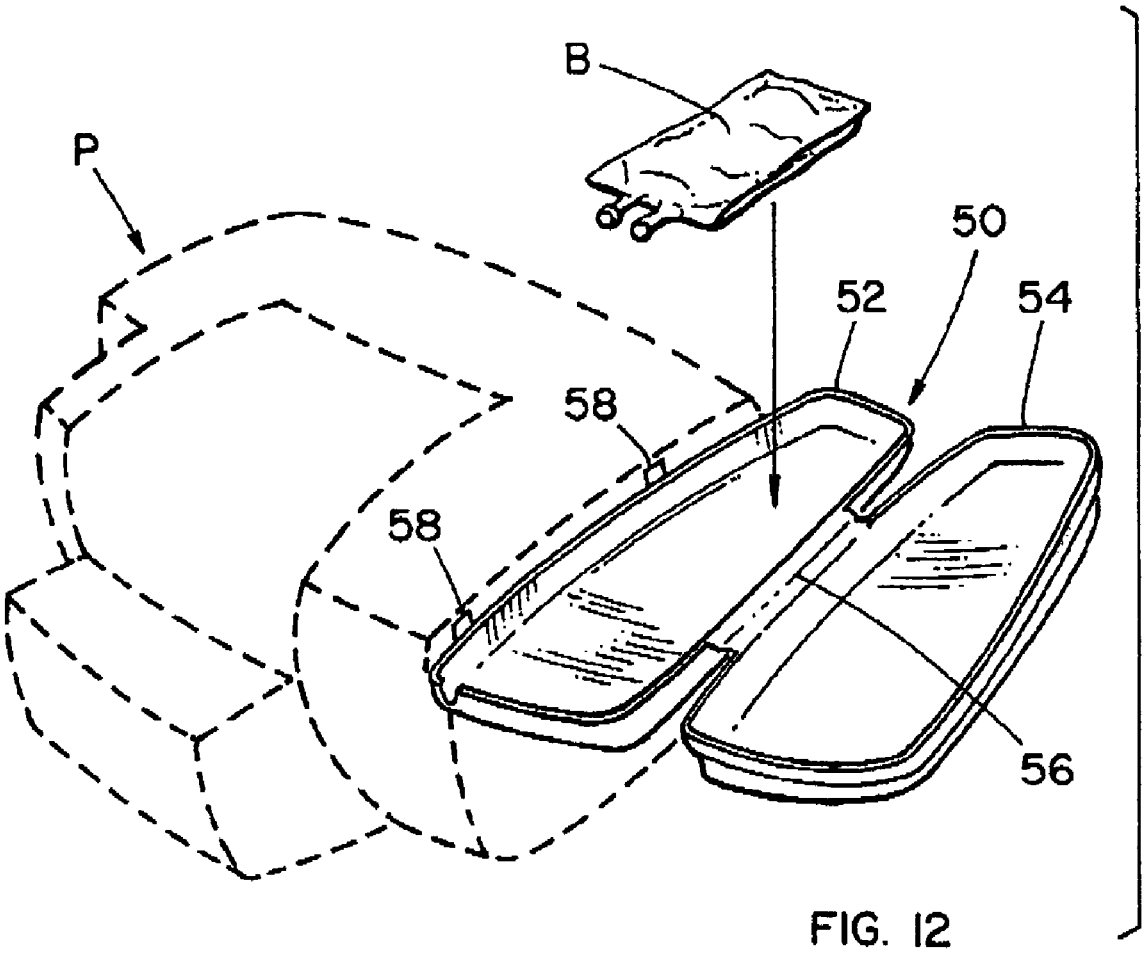
FIGS. 12, 13, and 14 are views of a further embodiment.
Figure 13:
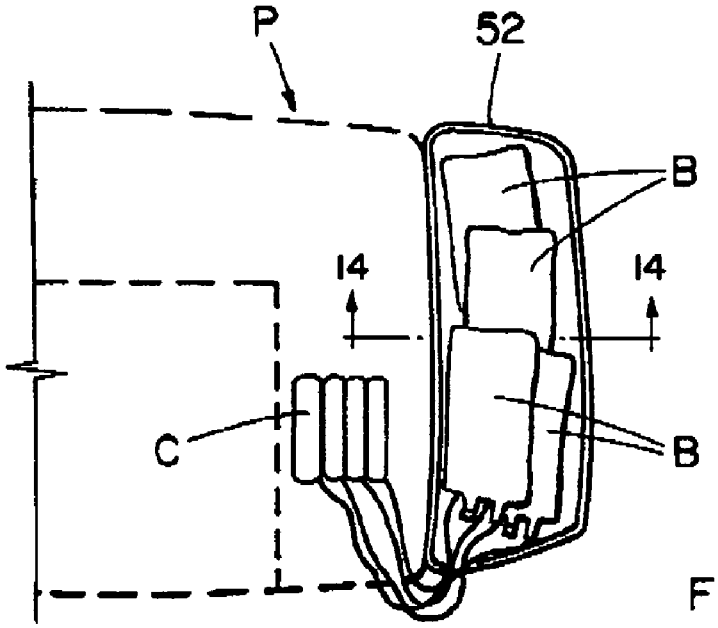
Figure 14:
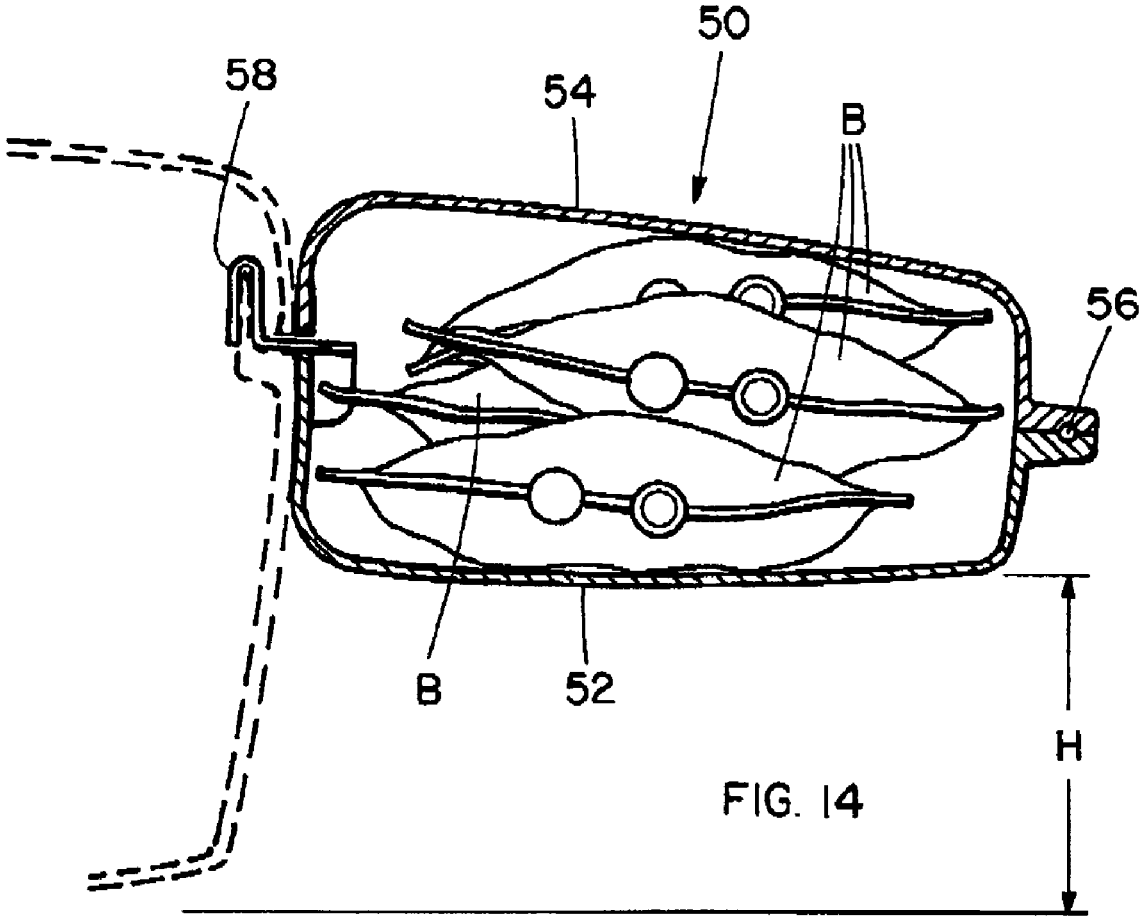

As shown in FIGS. 12, 13, and 14, a further embodiment of the invention comprises a ink supply housing indicated generally as (50). Housing (50) comprises a tray or shelf portion (52), and a lid (54). Preferably, although not essentially, the lid (54) is attached by means such as a hinge 56. Hinge (56) may, if desired, be a integrally molded self hinged formed plastic, or any other form of hinge.

Tray (52) is attachable to the printer indicated generally as (P) by means of a hook or hooks (56). The hooks (56) are formed of sheet metal, in this case, and typically hook over a portion of the printer housing. Various different hook systems will be devised for different designs of printers and different makes.

The hooks maintain at a shelf at a predetermined height (H) above the base of the printer. This elevation will provide the gravity flow of ink in the manner described above, which will supply ink to the ink cartridges with more ink jet heads, within the printer.

The tray (52) and lid (54) preferably provide an interior enclosed space sufficient to receive a plurality of ink supply containers or bags indicated generally as (B). Typically there will be four such bags (B), one for black, one for the other three coloured inks. Connections will be made from the bags (B) to the printheads or printer cartridges indicated generally as (C) within the printer (P).

Clearly, the lid (54) may be provided with some form of closure (not shown) for retaining it in a closed position as shown in FIG. 14. Alternatively, such a closure system may not 19 be required, and the lid may simply be retained in position by its own weight. Conceivably the lid or tray may incorporate some form of pressure medium. Such a medium might take the for of another bag (not shown), which might be expandable by means such as air or gas pressure, of even water pressure, if desired.

The foregoing is a description of the preferred embodiment of the invention which is given here by way of example only. The invention is not to be taken as limited to any of these specific features as named or described, but comprehends all such variations as come within the scope of the following claims.

What is claimed is:

1. An expanded ink supply system for an inkjet printer having a print carriage and print heads that moves in relation to a print medium and at least one ink cartridge inside said printer, said print cartridge having an inner part holding a first quantity of ink an inner part ink fill port, comprising:

an ink container locatable outside said printer body for containing a second quantity of ink;

tubing means for transferring ink from said ink container to said cartridge via said cartridge fill port;

said tubing extending out through said fill port of said ink cartridge thereby fluidically connecting between said cartridge and said ink container at its location outside the body of said printer;

whereby said ink in said cartridge is supplemented by ink transferred from said ink container, wherein said ink container is in the form of a bag and wherein said bag is adapted to be inserted underneath said printer whereby to apply the mass of said printer to said bag for delivery of ink therefrom to said cartridge.

2. The expanded ink supply as claimed in claim 1 wherein the ink in the cartridge is in fluid connection with the ink contained in the container external to the inkjet printer.

3. The expanded ink supply as claimed in claim 1 wherein the ink container is in the form of a bag containing said ink located at a height above the ink fill port of the print cartridge; and means to support said bag at said height.

4. The expanded ink supply as claimed in claim 1 including a bag support attachable to the printer to support at least one ink bag fluidically connected to the ink container, at a height above said ink fill port.

5. The expanded ink supply system of claim 1 wherein the print cartridge comprises a casing, and a transparent cap for said casing to allow the user to check the amount of ink remaining in the cartridge.

6. The expanded ink supply as claimed in claim 1 and including means to structurally support and attach at least one ink container to a separate stand not attached to the printer.

7. The expanded ink supply as claimed in claim 1 wherein said support is attachable to said printer by support clips, and including a cover removable placeable over said support.

8. The expanded ink supply as claimed in claim 7 wherein, the ink container is horizontally disposed on a compressible medium and said ink container, and a pressure plate inserted between said printer and said ink container.

9. The expanded ink supply as claimed in claim 1 including:

a fitting adapted to be inserted into the ink fill port in the print cartridge to allow the fluid conduit free passage.

10. A method of supplying make up ink to an ink cartridge in an ink jet printer, said cartridge having an ink fill port, and comprising the steps of connecting an ink container to said fill port of said ink cartridge of an ink jet printer, applying pressure to said ink in said ink container whereby to cause said ink to flow from said ink container to said ink cartridge and including the steps of threading said fill port and screwing a connection fitting into said fill port.

11. A method supplying to make up ink to an ink cartridge in an ink jet printer, as claimed in claim 10 and further including the steps of heating the make up ink.

12. A method supplying to make up ink to an ink cartridge in an ink jet printer, as claimed in claim 10 and further including the steps of venting air from said ink cartridge prior to admitting said make up ink thereto.

13. A method supplying to make up ink to an ink cartridge in an ink jet printer, as claimed in claim 10 wherein said cartridge has a flexible diaphragm and including the steps of holding the cartridge so that any air inside the cartridge will be stored in the immediate vicinity of the cartridge ink fill port, and activating said flexible diaphragm to pressurize the air, and turning the cartridge right side up to allow any air ingested into the cartridge to rise.

14. A method supplying to make up ink to an ink cartridge in an ink jet printer, as claimed in claim 13 and including the step of immersing the ink container in a medium at a higher temperature than room temperature.

15. An expanded ink supply system for an inkjet printer having a print carriage and print heads that move in parallel in relation to a print medium and a plurality of detachably removable print cartridges inside said printer, each of said print cartridges having a casing, an end cap and an inner part holding a first quantity of ink in a containment, the inner part further having a pump mechanism with a check valve and a depressible diaphragm for operating said mechanism, an inner part fill port blocked by a stopper and a septum, and comprising a plurality of ink containers; tubings for transferring liquid ink from said containers to said inner part, a connection fitting in each said inner part fill port; said tubings being attached to said fittings to fluidically connect to said ink containers located outside the body of said printer;

wherein each said ink container is in the form of a bag and wherein said bag is supported whereby it is subjected to a mass weight for causing delivery of ink therefrom to said cartridge.

16. The expanded ink supply as claimed in claim 15, wherein said ink containers each comprise:

a collapsible bag with a bag outlet port located at a height above the inner part fill port of the cartridge; and means to support said ink containers adjacent to edge of said printer.

17. The expanded ink supply as claimed in claim 15 wherein said ink containers each comprises:

an ink bag with an outlet at a height below the inner part fill port of the print cartridge; mass means on said bag to force the liquid ink to the higher level of said inner part fill port.

18. The expanded ink supply system as claimed in claim 15 wherein each said cartridge is continuously replenished through said inner part fill ports while in operation inside a print cartridge compartment inside said printer.

* * * * *